US008550229B2

(12) United States Patent
Tanaka

(10) Patent No.: US 8,550,229 B2
(45) Date of Patent: Oct. 8, 2013

(54) FOOD PLATE CARRIER

(75) Inventor: Kunihiko Tanaka, Sakai (JP)

(73) Assignee: Kura Corporation Ltd., Osaka (JP)

( * ) Notice: Subject to any disclaimer, the term of this patent is extended or adjusted under 35 U.S.C. 154(b) by 0 days.

(21) Appl. No.: 13/587,175

(22) Filed: Aug. 16, 2012

(65) Prior Publication Data

US 2012/0325624 A1 Dec. 27, 2012

Related U.S. Application Data

(63) Continuation of application No. PCT/JP2011/075928, filed on Nov. 10, 2011.

(30) Foreign Application Priority Data

Dec. 9, 2010 (JP) ..... 2010-274181

(51) Int. Cl.
*A47F 10/06* (2006.01)
*A47G 23/08* (2006.01)

(52) U.S. Cl.
USPC ..... 198/465.1; 186/49

(58) Field of Classification Search
USPC ..... 198/465.1; 186/49
See application file for complete search history.

(56) References Cited

U.S. PATENT DOCUMENTS 6,427,806 B1 * 8/2002 Tanaka ..... 186/49
6,581,727 B1 * 6/2003 Tokuno ..... 186/50
6,675,950 B1 * 1/2004 Collon ..... 198/465.2
7,810,427 B2 * 10/2010 Ishino et al. ..... 99/483
2009/0294217 A1 12/2009 Tanaka et al.

FOREIGN PATENT DOCUMENTS

| | | |
|---|---|---|
| JP | 7-255582 | 10/1995 |
| JP | 2000-23818 | 1/2000 |
| JP | 2001-299553 | 10/2001 |
| JP | 2009-284925 | 12/2009 |

OTHER PUBLICATIONS

International Search Report issued Feb. 14, 2012 in International (PCT) Application No. PCT/JP2011/075928.

* cited by examiner

*Primary Examiner* — Mark A Deuble
(74) *Attorney, Agent, or Firm* — Wenderoth, Lind & Ponack, L.L.P.

(57) ABSTRACT

A food plate carrier is carried on a conveyor line of a conveying system to transport food to the tables and seats in a restaurant. The food plate carrier includes a mounting platform having a plate resting portion for supporting a plate on which food is put, a cap member attached to the mounting platform so as to open and close with respect to the plate resting portion, to cover the plate resting portion of the mounting platform, and an open and close mechanism for allowing the cap member to close when the dish is rested on the plate resting portion and open when the dish is removed therefrom. The open and close mechanism comprises an actuator which is brought into abutment with the dish when the dish is on the plate resting portion, thereby being actuated to move relative to the plate resting portion.

14 Claims, 18 Drawing Sheets

FOOD PLATE CARRIER

This application is a Continuation of International Application No. PCT/JP2011/075928, filed Nov. 10, 2011, the entire disclosure of which is incorporated herein by reference.

TECHNICAL FIELD

The present invention relates to a food plate carrier used for a food conveying system in a restaurant.

BACKGROUND ART

A restaurant that is generally called a revolving self-service sushi restaurant is provided with a food conveying system including a conveyor line to encircle tables and seats. In this type of restaurant, a cook puts food such as sushi on e.g. a dish and then feeds the dish into the encircling conveyor line of the food conveying system to transport it to the tables and seats in order. A customer selects the dish on which the sushi or food of his/her choice is put from the dishes conveyed in order, taking it out from the conveyor line.

In this sushi restaurant, since the dish is conveyed with its top surface open to the air, the sushi on the conveyor line is easy to dry and may possibly be touched by mistake by other customers. Preventing sushi from drying and providing it sanitarily are being outstanding issues for solution. In order to solve the problems noted above, it is in general suggested that after sushi is put on the dish, the dish is covered by a cover member and then the covered dish is fed onto the conveyor line of the conveying system (See Patent Literature 1).

CITATION LIST

Patent Literature

Patent Literature 1: Unexamined Patent Publication No. 2001-299553 (Japan)

SUMMARY OF INVENTION

Technical Problem

The solution presented by the Patent Literature 1 requires, however, that the cook hold the cover member with his/her hand directly and put it on the dish and in turn feed the dish onto the conveyor line together with the cover member. It also requires that the customer take out the dish from the conveyor line together with the cover member and in turn remove the cover member from the dish with his/her hand directly. In addition, that solution presents the disadvantage that since the cook or the customer holds the cover member with his/her hand each time putting the cover member on the dish or removing the cover member therefrom, the cover member comes to be dirty. It also presents the disadvantage that since the cover member, after removed from the dish, is laid on the table, the space of the table becomes narrower.

Accordingly, it is an object of the invention to provide a food plate carrier that can enable a plate to be placed on or removed from a mounting platform in a simple and easy manner without touching the mounting platform or a cap member to cover the mounting platform.

Solution to Problem

In order to accomplish the object mentioned above, the invention provides a food plate carrier which is carried, being put on a conveyor line of a food conveying system to transport food to the tables and seats in the restaurant, the food plate carrier comprising a mounting platform having a plate resting portion for resting thereon a plate on which food is put, a cap member which is attached to the mounting platform in such a manner as to open and close with respect to the plate resting portion, to cover the plate resting portion of the mounting platform, and an open and close mechanism for allowing the cap member to close when the plate is rested on the plate resting portion and open when the plate is removed therefrom.

Since the food on the plate is automatically covered by the cap member, with the plate placed on the mounting platform, the food on the plate can be prevented not only from drying obliviously but from being touched by mistake by other customers. Also, when the plate is placed in or removed from the mounting platform, one can do that easily by simply handling the plate to take it into or out from the mounting platform, with e.g. a rim of the plate held with fingers. Besides, since one need not touch the food plate carrier directly with one's hand when taking the plate in and out, the food plate carrier can be prevented from dirtying imprudently.

Further, the open and close mechanism comprises an actuator which when the plate is rested onto the plate resting portion, is brought into abutment with the plate and thereby is put into action to move relative to the plate resting portion, connecting means to connect the actuator with the cap member so that the movement of the actuator is transmitted to the cap member to actuate the cap member to close, and biasing means for biasing the cap member toward its opened position.

When the plate is rested on the plate resting portion, the actuator is responsively brought into action so that the cap member can be switched to its closed position, while on the other hand, when the plate is taken out from the mounting platform, the actuator is responsively brought into action via the biasing means and thereby the cap member can be reliably biased toward its opened position. This can provide the effect that the opening and closing action of the cap member can be provided further reliably and smoothly on the whole.

Further, an identification member which is readable by a reader arranged in the food conveying system is arranged on the mounting platform in such a manner that it can switch between a readable position at which it can be read by the reader and an unreadable position in association with the opening and closing action of the cap member, the identification member being arranged so that when the plate is rested on the plate resting portion, it can be shifted to the readable position, while on the other hand, when the plate is taken out from the plate resting portion, it can be shifted to the unreadable position.

When the plate is placed in the mounting platform, the reading of the identification member by the reader is allowed. On the other hand, when the plate is taken out from the mounting platform, the reading of the identification member by the reader is not allowed. This can provide the effect that freshness management of the food on the plate can be made in a preferred manner, without the need to e.g. attach the identification member on the plate itself as conventional.

Further, adjoining mounting platforms of at least two food plate carriers arranged in side-by-side relation is linked in close proximity relation via linkage means.

This can provide the effect that the food plate carriers thus linked can be suitably used for the food conveyor system having a circulatory shunt mechanism which is provided, at an intermediate location of the conveyor line extending to the customer section of the restaurant, for shunting the food plate carriers at that intermediate location. This means that even when the food plate carriers thus linked are shunted from the main conveyor line to a shortened conveyor line formed by the circulatory shunt mechanism and thereafter are returned again to the main conveyor line, the take-out side of the mounting platform from which the plate is taken out can be always oriented to face the customers or the table side. This can allow the customer to take out the plate from the food plate carrier more easily.

Further, the linkage means is formed by a stretchable string-like member.

The invention can provide the effect that when one of the food plate carriers thus linked, e.g., the food plate carrier located at the rear side with respect to the travelling direction, gets stuck on the main or shortened conveyor line, the string-like member is stretched and tensed temporarily to thereby produce a force to draw the food plate carrier located at the rear side close to the one located at the front side, thereby automatically releasing the food plate carriers from jamming on the conveyor line.

Further, the food plate carrier comprises time detecting means for detecting the time during which the cap member closes.

This can provide the effect that the food put on the mounting platform can be determined as it is on whether it already passed away a predetermined time and thus the freshness management of the food can be made in a preferred manner.

Further, the food plate carrier comprises an accommodation space for accommodating cold insulator or hot insulator to keep cool or warm the space above the plate resting portion covered by the cap member.

This can provide the effect that deterioration of the food on the mounting platform can be prevented further reliably.

DESCRIPTION OF EMBODIMENTS

In the following, certain embodiments of the invention will be described in detail with reference to the accompanying drawings.

Figure 1:
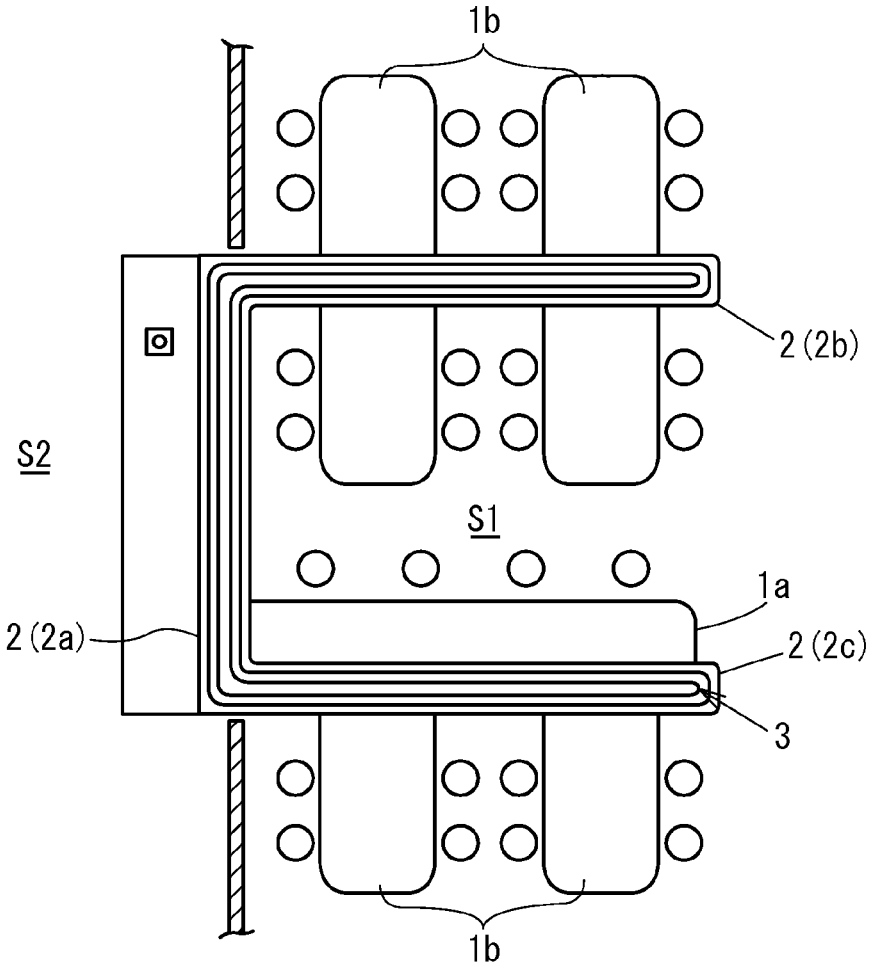
FIG. 1 is a planar block diagram, schematically illustrating an interior of a sushi restaurant using food plate carriers of a certain embodiment of the invention.
Figure 2:
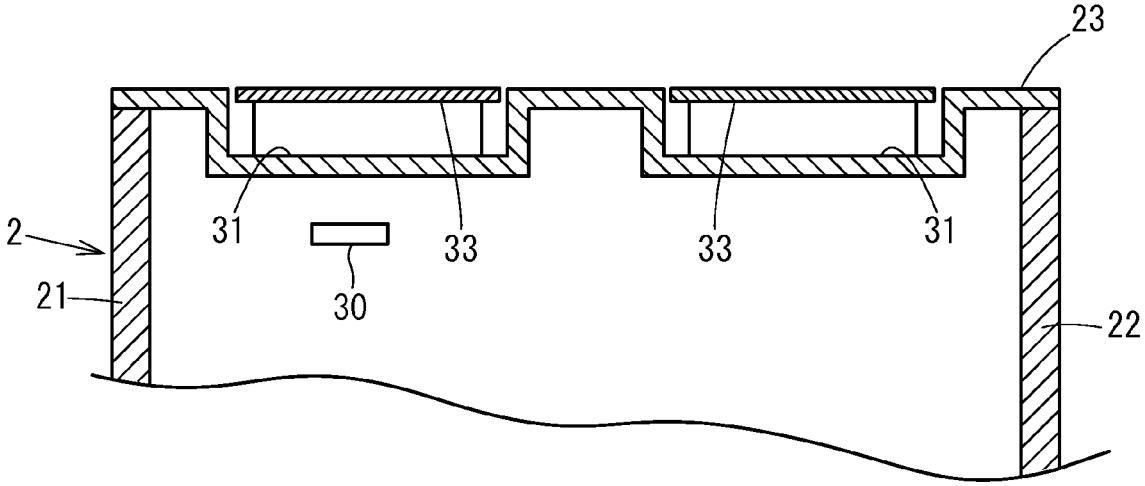
FIG. 2 is a sectional view of a relevant part of the food conveyor system.

An interior of a sushi restaurant using food plate carriers of a certain embodiment of the invention is described, first. FIG. 1 is a planar block diagram, schematically illustrating the interior of the sushi restaurant, and FIG. 2 is a sectional view of a relevant part of the food conveyor system. As shown in FIGS. 1 and 2, the sushi restaurant is provided with a counter-type table 1*a* and legged tables 1*b* arranged at the seats in the customer section S1, a partition housing 2 extending from the front side of the kitchen section S2 along the respective tables 1*a*, 1*b*, and a food conveying system 3 arranged over the partition housing 2. The food conveying system functions to transport a food plate carrier of the embodiment of the invention, in which a plate on which sushi F, which is cited as an example of food in the invention, is put is housed, to the seats and tables 1*a*, 1*b* from the interior of the kitchen section S2 in an encircling manner. In this embodiment, a dish 4 (shown in FIG. 3 and other drawing figures) is used as the plate on which sushi is served.

As shown in FIG. 2, the partition housing 2 is formed in substantially a box shape in cross section, using side walls 21, 22 which are oppositely disposed with a predetermined space, a top wall 23 connecting between upper ends of the side walls 21, 22, and a bottom wall (not shown) connecting between lower ends of the same. The partition housing 2 comprises a first housing portion 2*a* which is arranged along the front side of the kitchen section S2 to partition the kitchen section S2 from the customer section S1, a second housing portion 2*b* and a third housing portion 2*c* which are curved at both longitudinal ends of the first housing portion 2*a* and are extended in parallel to the interior of the customer section 51. The counter-type table 1*a* and the legged tables 1*b* are arranged at the outside of the side walls 21, 22 of the second and third housing portions 2*b*, 2*c*. The food conveying system 3 comprises a recess 31 formed by recessing the top wall 23 of the housing 2 downwardly, and an endless flat chain conveyor 33 disposed in the recess 31 and moved in circulation via motor drive. In the illustrated embodiment, the flat chain conveyor 33 forms the conveyor line. The partition housing 2 has in an interior thereof a reader 30, disposed under the flat chain conveyor 33, for reading data written on an identification member 9 mentioned later.

In the food conveying system 3 thus constituted, the dishes 4 putting sushi F thereon are put on the flat chain conveyor 33 in order and are transported from the kitchen section S2 toward the tables 1*a*, 1*b* in the customer section S1. Customers at the tables 1*a*, 1*b* each take out the dish 4 on which sushi F of their choice is put from the food plate carrier 5 to have it. In this example, the dish 4, which is cited as an example of the plate in the invention, comprises a flat plate part 41 of a circular shape as viewed from top, and a base part 42 of cylindrical shape which is integrally formed to extend downwardly from the bottom of the flat plate part 41.

Figure 3:
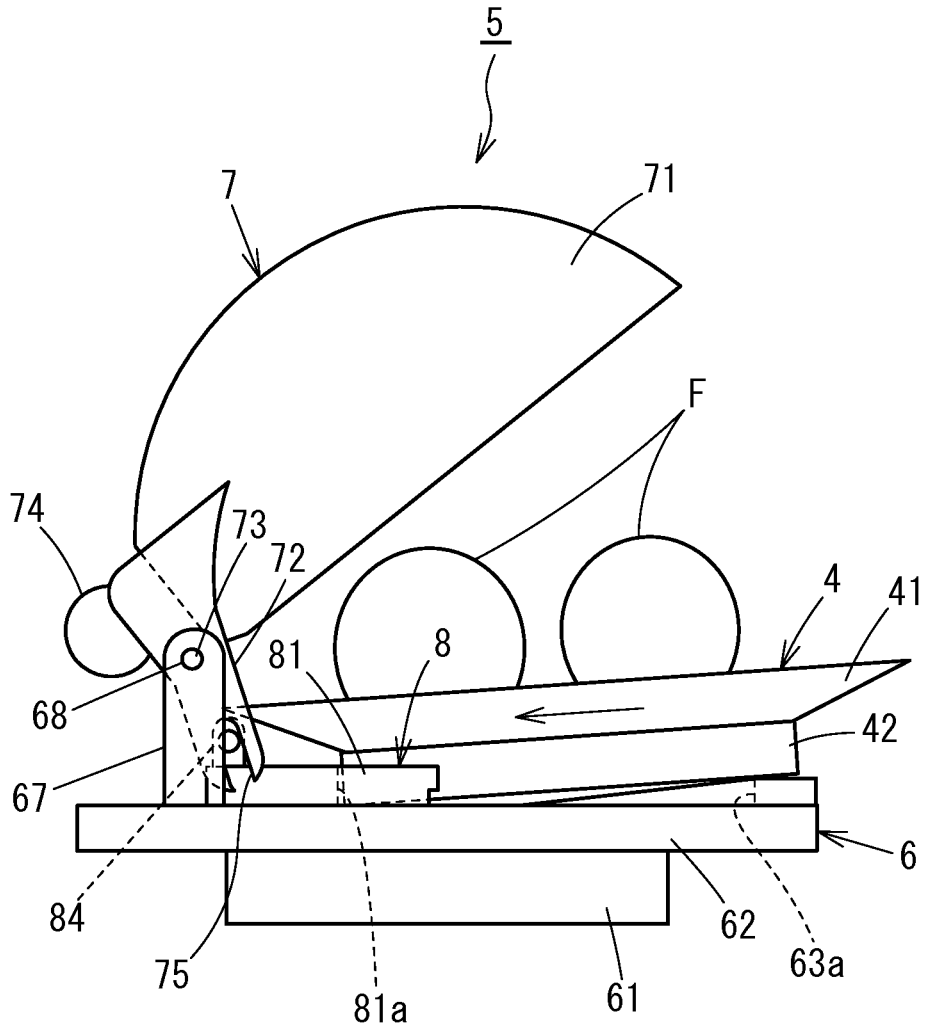
FIG. 3 is a side elevation view, illustrating the state that the cap member of the food plate carrier is opened and the dish is being put into the plate.
Figure 4:
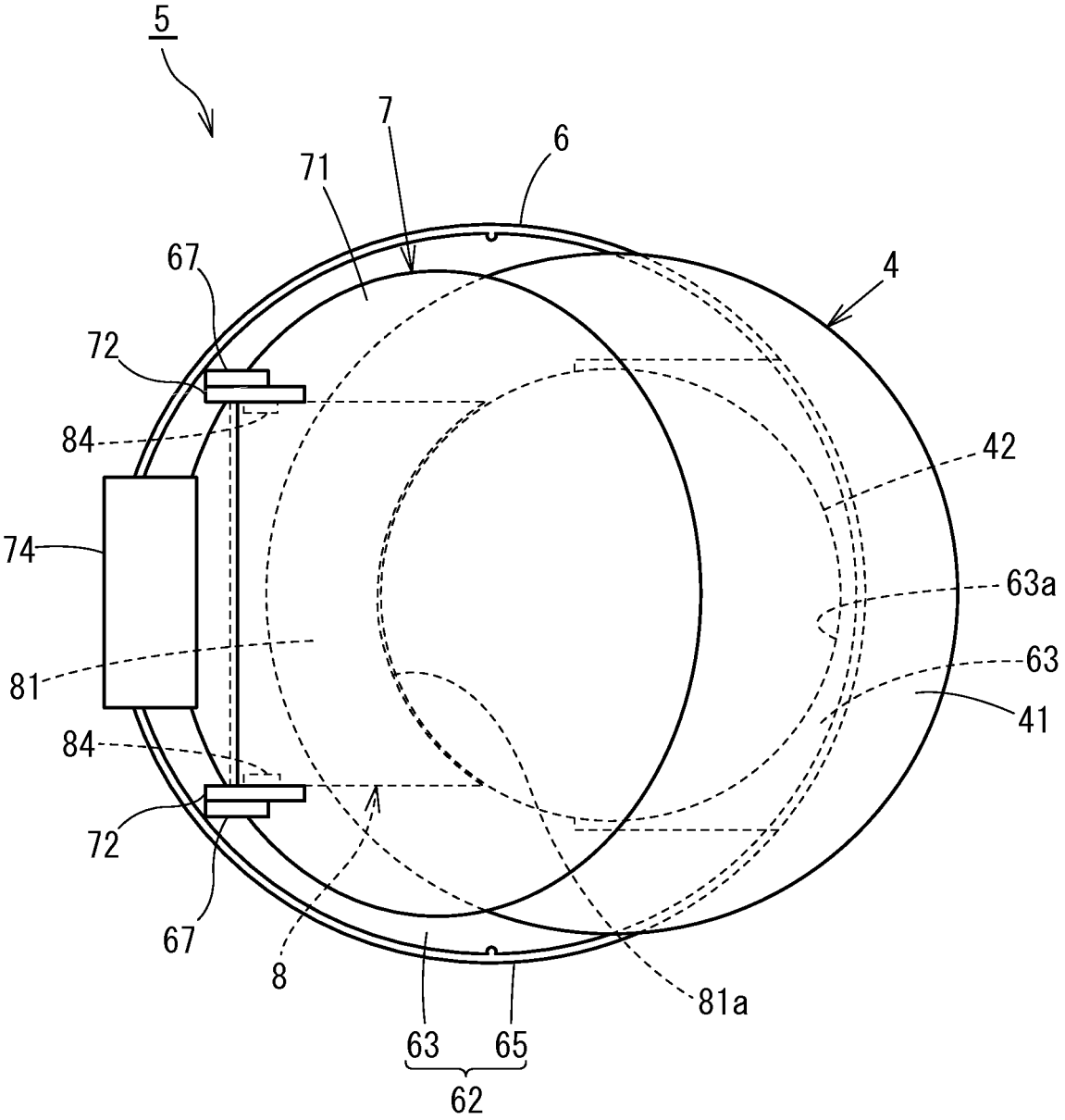
FIG. 4 is a plan view of the food plate carrier shown in FIG. 3.
Figure 5:
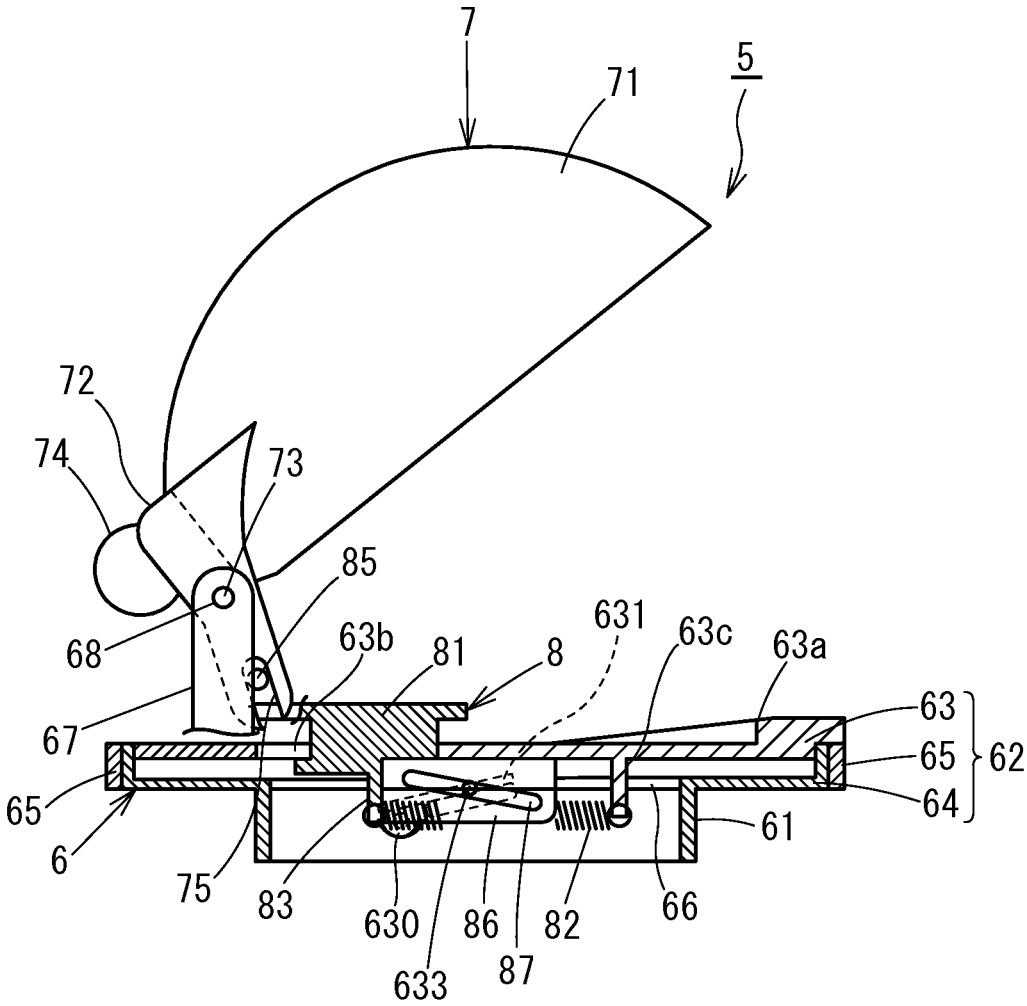
FIG. 5 is a partly-sectioned side elevation view of a relevant constitution part, illustrating the state that the cap member of the food plate carrier is opened.
Figure 6:
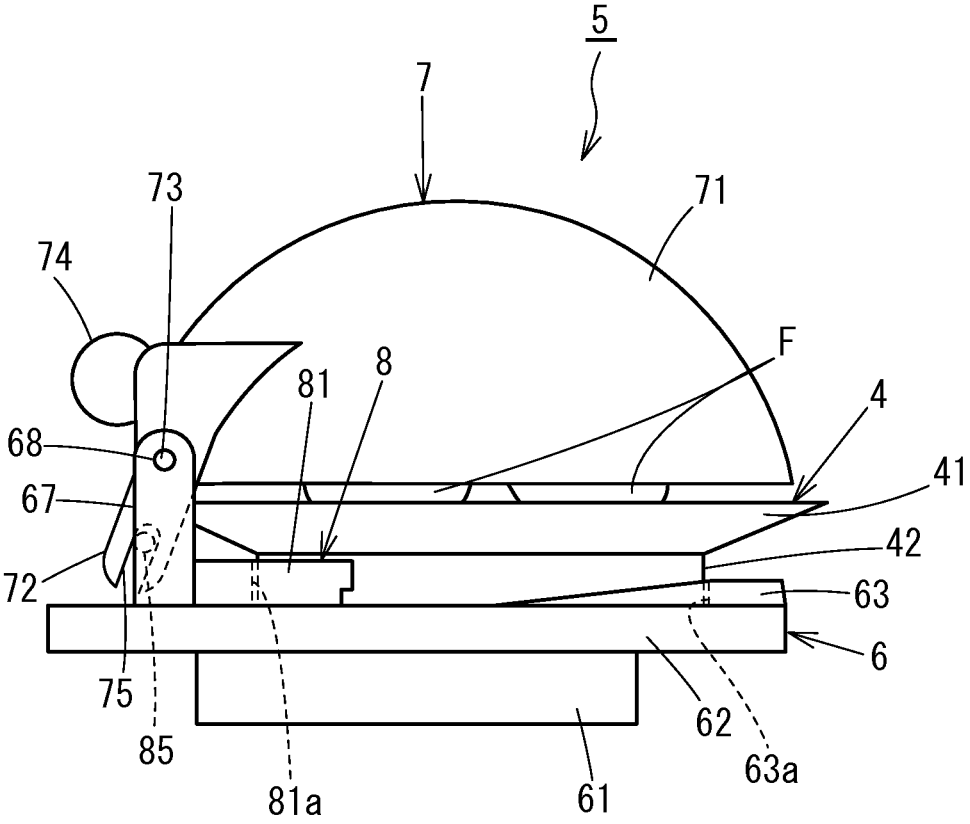
FIG. 6 is a side elevation view, illustrating the state that the dish is housed in the food plate carrier and then the cap member is closed.
Figure 7:
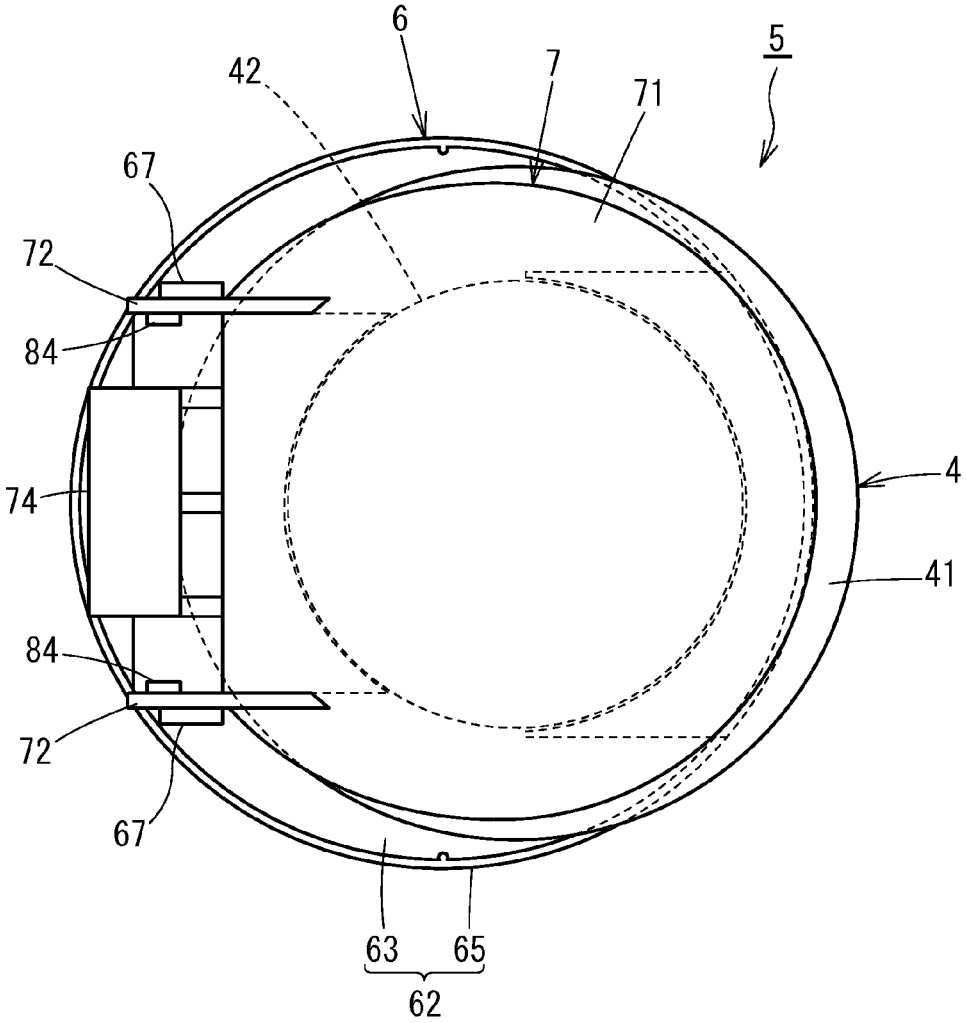
FIG. 7 is a plan view of the food plate carrier shown in FIG. 6.

Next, the food plate carrier of a certain embodiment of the invention is described. FIG. 3 is a side elevation view, illustrating the state that the cap member of the food plate carrier is opened and the dish is being put into the plate. FIG. 4 is a plan view of the food plate carrier shown in FIG. 3. FIG. 5 is a partly-sectioned side elevation view of a relevant constitution part, illustrating the state that the cap member of the food plate carrier is opened. FIG. 6 is a side elevation view, illustrating the state that the dish is housed in the food plate carrier and then the cap member is closed. FIG. 7 is a plan view of the food plate carrier shown in FIG. 6. The food plate carrier of the embodiment is put on the flat chain conveyor 33 of the food conveying system 3 and is carried by it.

Referring to FIGS. 3-5, the food plate carrier designated by symbol 5 basically comprises a mounting platform 6 having a plate resting portion 62 for resting the dish 4 thereon, a cap member 7 for covering the plate resting portion 62 of the mounting platform 6, and an open and close mechanism 8 for allowing the cap member 7 to close in response to the dish 4 being placed on the plate resting portion 62 and allowing the cap member 7 to open in response to the dish 4 being taken out therefrom.

The mounting platform 6 is so formed that the plate resting portion 62 is integrally formed at an upper end of a cylindrical base 61, as shown in FIG. 3. The dish 4 is placed on a top surface of the plate resting portion 62. The plate resting portion 62 comprises, as shown in FIG. 5, a mounting plate 63 formed in a circular disc shape as viewed from top, an opposed plate 64 which is oppositely disposed under the mounting plate 63 with a predetermined space, and a cylindrical coupling plate 65 which surrounds peripheries of the mounting plate 63 and the opposed plate 64. The opposed plate 64 has, at a center portion thereof as viewed from top, a through hole 66 extending through in a vertical direction. The cylindrical base 61 is formed in such a manner as to extend downwardly from the periphery of the through hole 66 of the opposed plate 64. The mounting plate 63 has, at a top surface thereof, a stopper 63*a* of a shape to engage with an outer periphery of the base part 42 of the dish 4 at the bottom end. The stopper 63*a* has an inner periphery formed in a curved shape, as viewed from top, to closely contact with and extend around the outer periphery of the base part 42, as shown in FIG. 4.

Figure 8:
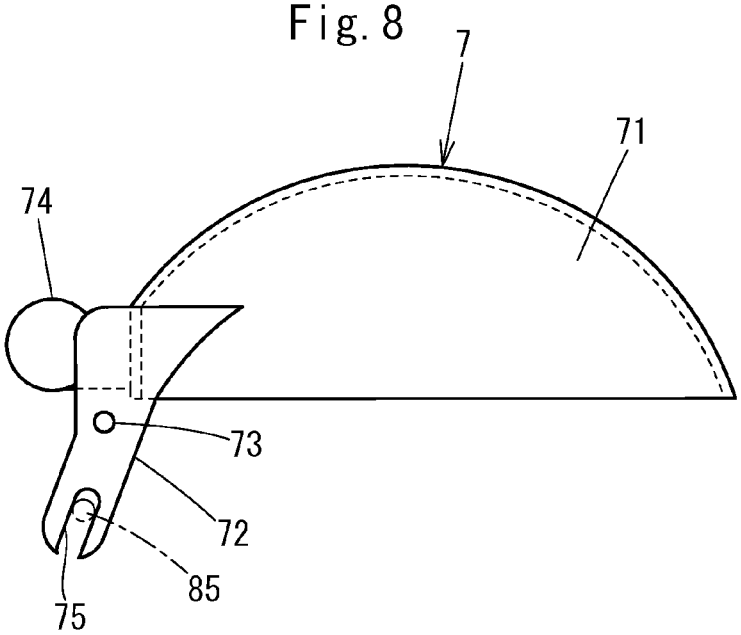
FIG. 8 is a side elevation view of the cap member of the food plate carrier.

The cap member 7 comprises, as shown in FIG. 8, a cap body 71 formed in a bowl shape, and a pair of right and left arms 72 extending downwardly from a rear end of the cap body 71. The cap body 71 and the arms 72 are formed of transparent synthetic resin. The cap member 7 is mounted on the plate resting portion 62 so that it can open and close with respect to the top surface of the plate resting portion 62 so that the cap body 71 can cover the food (sushi F) on the dish 4 placed in the plate resting portion 62. Specifically, each of the arms 72 has a pivot 73 integrally formed at a lengthwise intermediate portion thereof. The plate resting portion 62 is provided, at a rear end portion thereof on the front side, with a pair of right and left support lugs 67 which are located at the outside of the arms 72 so as to face the arms 72. The support lugs 67 have fitting holes 68 formed at upper portions thereof. The pivots 73 are fitted in the fitting holes 68 of the support lugs 67, whereby the cap body 71 is supported in such a manner as to pivot about the pivots 73 and swing in a vertical direction with respect to the plate resting portion 62. The cap body 71 has a balance weight 74 fitted in a rear end portion thereof. The balance weight 74 assists the cap body 71 swinging smoothly to the position where it covers the food on the dish 4 placed in the plate resting portion 62 or swinging smoothly from the closed position to the opened position. The balance weight 74 need not be provided necessarily.

Figure 9:
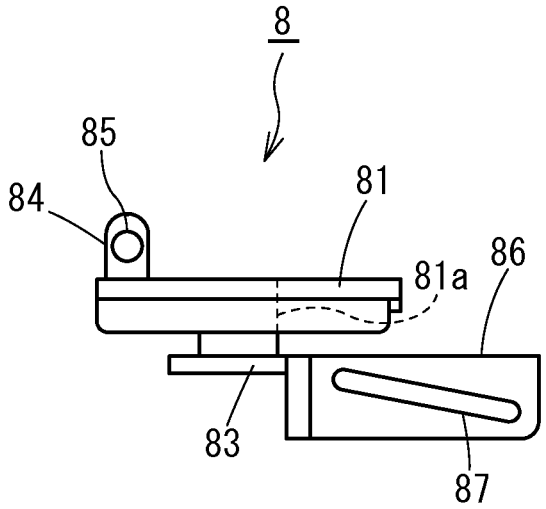
FIG. 9 is a side elevation view of an actuator which forms an open and close mechanism of the food plate carrier.
Figure 10:
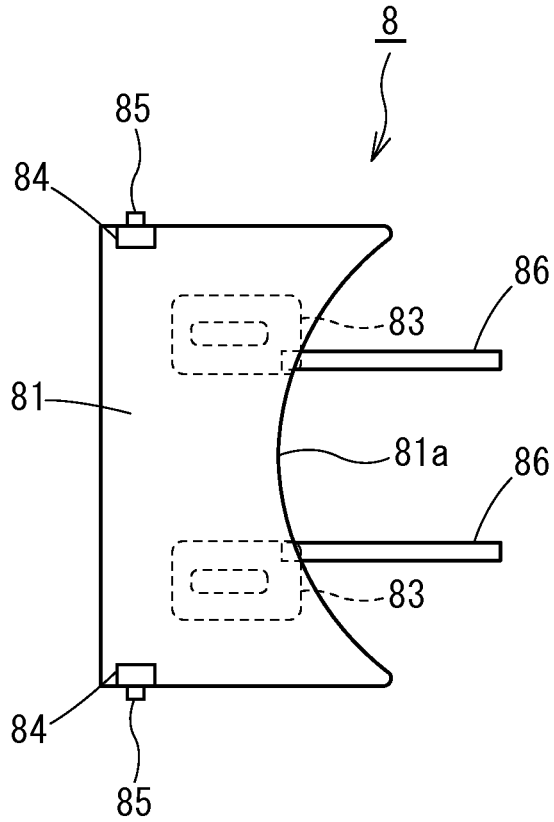
FIG. 10 is a plan view of the actuator.
Figure 11:
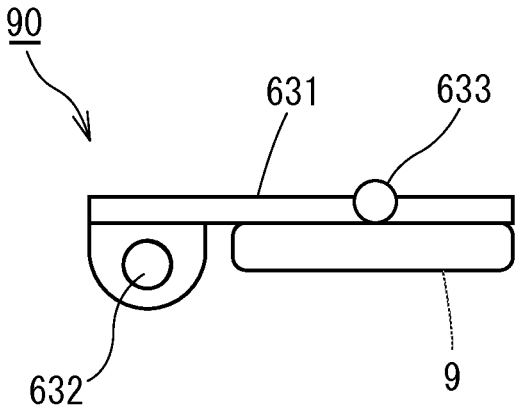
FIG. 11 is a side elevation view of interlocking means of an identification member on the food plate carrier.
Figure 12:
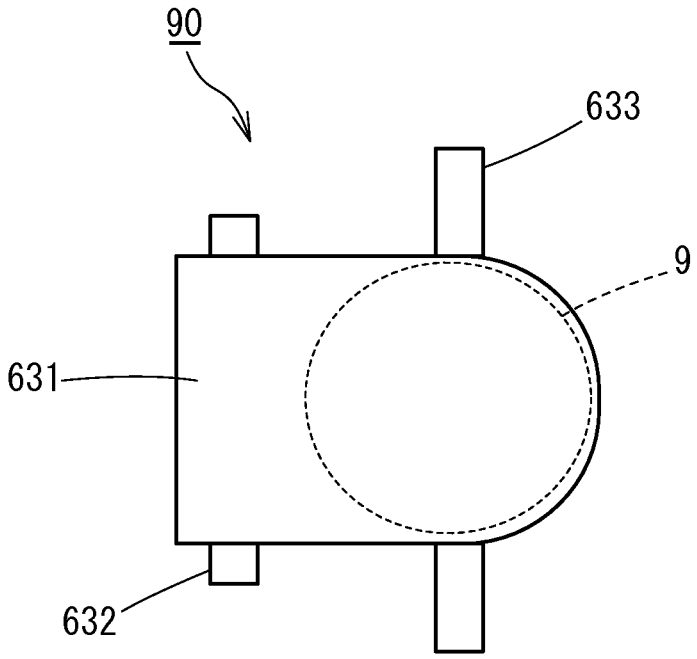
FIG. 12 is a plan view of the interlocking means of the identification member.

The open and close mechanism 8 comprises, as shown in FIGS. 9 and 10, an actuator 81 shaped like a flat plate and mounted on the top surface of the plate resting portion 62 of the mounting platform 6 in such a manner as to be slidable in the back and forth direction, and a coiled spring 82 for biasing the actuator 81 forwardly of the plate resting portion 62. The coiled spring 82 forms a biasing means. The actuator 81 has a pair of right and left guide members 83 provided on the bottom side in a projecting manner. The guide members 83 are loosely fitted into guide slots 63*b* produced in the mounting plate 63 of the plate resting portion 62 and extending in a back and forth direction, so that they can freely move back and forth. The coiled spring 82 is bridged between an end of the guide member 83 fitted and a pair of right and left mounting lugs 63*c* provided at a front portion of the mounting plate 63 on the bottom side. This enables the actuator 81 to move on the mounting plate 63 in the back and forth direction along the guide slots 63*b* via the guide members 83. The actuator 81 is always biased forwards by a reaction force of the coiled spring 82 stretched with the rearward movement of the actuator 81.

The actuator 81 has a front end face 81*a* formed in a curved shape, as viewed from top, to closely contact with the outer periphery of the base part 42 of the dish 4, as shown in FIG. 10. Also, the actuator 81 has, at both rear end portions thereof, a pair of right and left lugs 84 extending upwardly. The lugs 84 have, at the outside, connecting shafts 85 projecting therefrom. The connecting shafts 85 are fitted in slits 75 formed in the arms 72 at lower ends thereof, so that with the rearward sliding action of the actuator 81, the cap body 71 is swung in the closing direction, while on the other hand, with the forward sliding action of the actuator 81, the cap body 71 is swung in the opening direction. The lugs 84, the connecting shafts 85, and the slits 75 form a connecting means.

In this embodiment, an identification member 9 which is readable by a reader 30 positioned in the food conveying system 3 is located on the mounting platform 6. The identification member 9 is located so that it can switch between a readable position at which the identification member 9 is readable by the reader 30 and an unreadable position in association with the opening and closing action of the cap member 7 via interlocking means 90. With the dish 4 rested on the plate resting portion 62, the identification member 9 is responsively switched to the readable position. On the other hand, with the dish 4 taken out from the plate resting portion 62, the identification member 9 is responsively switched to the unreadable position. Specifically, the interlocking means 90 is formed by a pair of right and left supporting limbs 630 which are provided in a projecting manner on the bottom side of the mounting plate 63 forming the plate resting portion 62, and a swinging plate 631 which is supported at the lower end partition of the supporting limbs 630 to swing vertically via the pivots 632. The identification member 9 of RFID (Radio Frequency Identification) tag is fixedly attached to the bottom side of the swinging plate 631, and interlocking shafts 633 are provided at both lateral sides of the swinging plate 631 in a projecting manner.

On the other hand, as shown in FIGS. 9 and 10, the pair of right and left guide members 83 mounted on the actuator 81 of the open and close mechanism 8 have, at their fitting ends, a pair of right and left guide plates 86 extending in the back and forth direction along the bottom of the plate resting portion 63. Guide slots 87 inclining downwardly from back to front are formed in the guide plates 86. The interlocking shafts 633 are fitted in the guide slots 87. With the actuator 81 moving from front to back with respect to the plate resting portion 62, the swinging plate 631 and the identification member 9 fixedly attached to the swinging plate 631 swing and are oriented substantially horizontal, enabling the identification member 9 to be read by the reader 30. On the other hand, with the actuator 81 moving from back to front with respect to the plate resting portion 62, the swinging plate 631 and the identification member 9 tilt, as shown in FIG. 5, disabling the identification member 9 from being read by the reader 30. It will be understood from this that the guide plates 86 and the interlocking shafts 633 form interlocking means. It is noted that the cap body 71 may be provided with a vent port to smoothly exhaust steam and the like from the cap body 71 through the vent port.

In the food plate carrier 5, when the dish 4 is in the state of being not rested on the plate resting portion 62, the actuator 81 is forced to move forward with respect to the plate resting portion 63 by a reaction force of the spring 82, so that the cap body 71 is kept in the opened state, as shown in FIGS. 3 and 4.

Next, usage of the food plate carrier 5 thus constituted is described.

After putting sushi F on the flat plate part 41 of the dish 4, a cook holds a rim of the flat plate part 41 with his/her hand and puts the dish 4 on the mounting plate 63 of the food plate carrier 5 put on the conveyor line 3, first. Then, he/she pushes the dish 4 backwards with respect to the mounting plate 63. Then, the actuator 81 of the open and close mechanism 8 is pushed by the periphery of the base part 42 of the dish 4 and is moved back. Then, the cap member 7 at the slits 75 is pressed back by the connecting shafts 85 of the actuator 81, to cause the cap body 71 to pivot about the pivots 73 and swing in the direction of covering the mounting plate 63. When the dish 4 is moved back to a location at which the periphery of the base part 42 at the bottom end on the front side is engaged with the stopper 63*a*, the base part 42 is held at its front and rear portions in sandwich relation between the stopper 63*a* of the plate resting portion 62 and the front end face 81*a* of the actuator 81, as shown in FIGS. 6 and 7. Thus, when the dish 4 is placed in the position where sushi F on the flat plate part 41 is covered by the cap body 71, the dish 4 is kept in position on the mounting platform 6 and the cap body 71 is also kept in its closed position, thus being kept from opening accidentally.

On the other hand, a customer holds the rim of the flat plate part 41, which partly projects outwardly from the periphery of the cap body 71, with his/her hand and lifts it up. As a result of this, the base part 42 is released from the abutment with the actuator 81. Then, the cap body 71 is opened and is kept in its opened position by the action of the balance weight 69 and the coiled spring 85, thus being kept from closing accidentally. When the dish 4 is rested on the mounting plate 63, the identification member 9 attached on the swinging plate 631 swings and is oriented substantially horizontal, enabling the identification member 9 to be read by the reader 30. On the other hand, when the dish 4 is taken out from the mounting plate 63, the identification member tilts with the actuator 81 moving forwards, disabling the identification member 9 from being read by the reader 30. Thus, freshness management of e.g. sushi F on the dish 4 can be made, without the need to mount the identification member 9 on the dish itself, as conventional.

Thus, the use of the food plate carrier 5 illustrated above for transporting sushi F can prevent the sushi F on the dish 4 from drying off obliviously. Also, the use of this food plate carrier 5 can prevent the sushi F from being touched by mistake by other customers. In addition, when the dish 4 is placed on or removed from the plate resting portion 62, one need not touch the food plate carrier 5 directly with one's hand, thus preventing the food plate carrier 5 from dirtying imprudently.

In the embodiment described above, the identification member 9 is arranged on the mounting platform 6 in such a manner that it can switch between the readable position where the identification member 9 is read by the reader 30 and the unreadable position. When the dish 4 is rested on the plate resting portion 62, the identification member 9 is shifted to the readable position, while on the other hand, when the dish 4 is taken out from the plate resting portion 62, the identification member 9 is shifted to the unreadable position. It is noted that the identification member 9 need not be attached on the mounting platform 6 necessarily.

In the embodiment illustrated above, the cap body 71 is so formed that when the cap body 71 is closed to cover the dish 4, the rim of the dish 4 partly projects outwardly from the periphery of the cap member 71. This can provide the result that when taking out the dish 4 from the food plate carrier, one can hold the outwardly projecting rim of the flat plate part 41 with one's fingers to pull it front. It is noted however that the invention is not limited to this. The cap member 71 may alternatively be formed to cover the whole area of the flat plate part 41 of the dish. Such an embodied form and a further embodied form in which the identification member 9 is not attached on the mounting platform are shown in FIGS. 13-25. In the food plate carrier 5A of another embodiment schematically shown in FIGS. 13-15, the plate resting portion 62A is formed by the mounting plate 63A formed in a circular disc shape as viewed from top, and the cylindrical base 61 is formed to be integral with the mounting plate 63A, projecting from the bottom of the same. The arrangement described above can provide a downsized food plate carrier and a simplified structure. It is noted that the mounting of the balance weight 74 on the cap body 71A is omitted from the food plate carrier 5A shown in FIG. 13 and other drawing figures.

Figure 13:
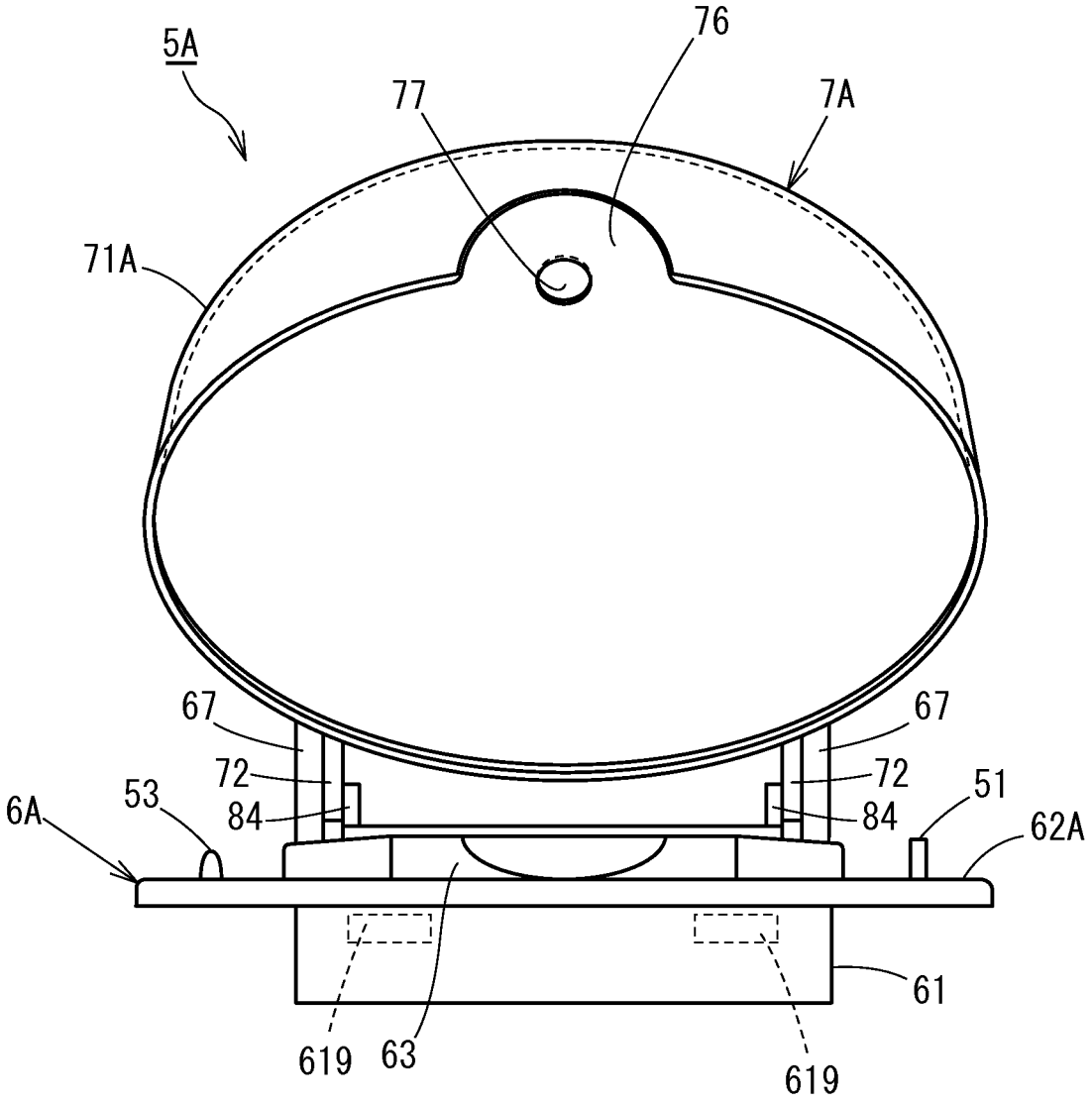
FIG. 13 is a front view, illustrating the state that the cap member of the food plate carrier of another embodiment is opened.
Figure 14:
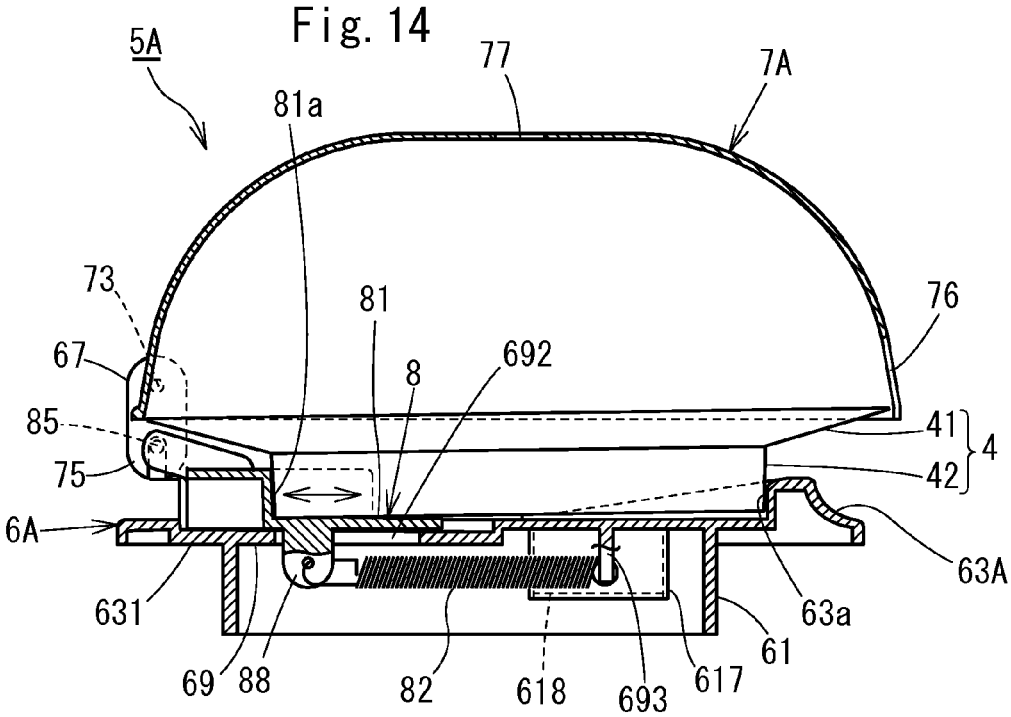
FIG. 14 is a partly-sectioned side elevation view of a relevant constitution part, illustrating the closed state of a cap member of the food plate carrier of another embodiment.
Figure 15:
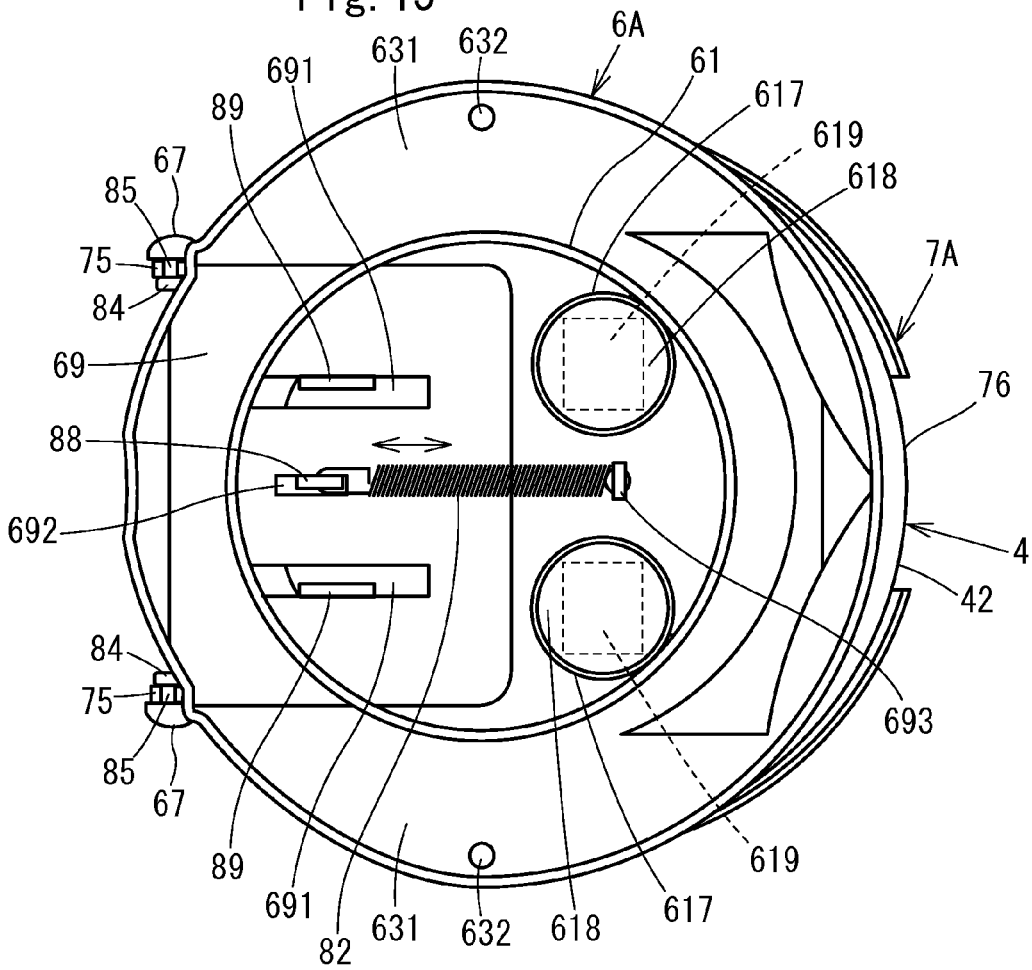
FIG. 15 is a bottom view of the food plate carrier of another embodiment.

In the embodiment wherein the cap body 71A is formed to cover the whole upper area of the flat plate part 41, as shown in FIGS. 13, 14 and 15, the cap body 71A may be formed to have, at a marginal portion thereof, a cutout 76 of a size for one's fingers to pass through. When taken out, the dish 4 is held at a rim of the flat plate part 41 with one's fingers put into from the cutout 76. It is noted that parts of the food plate carrier 5A corresponding to those of the food plate carrier 5 described above are labeled like reference numerals, and the explanation on those parts is omitted, except when deemed necessary. A guide slot 692 extending in the back and forth direction is formed at a transverse-wise center portion of a lower surface 69 of the mounting platform 63A in the cylindrical base 61. Guide slots 691, 691 extending in the back and forth direction are formed at the sides of the guide slot 692. Guide lugs 89, 89 projecting from the bottom of the actuator 81 are inserted in the right and left guide slots 691, 691, to prevent transverse rolling of the actuator 81 when travelling in the back and forth direction. A drooping lug 88 projecting from the bottom of the actuator 81 is inserted in the guide slot 692. A coiled spring 82 is hooked with its one end hooked over the drooping lug 88 and the other end hooked over a drooping lug 693 projecting from the lower surface 69 of the mounting platform 63A. Through holes 632, 632 mentioned later are formed in the rim of the mounting platform 63A at its portion on the right and left sides.

Figure 16:
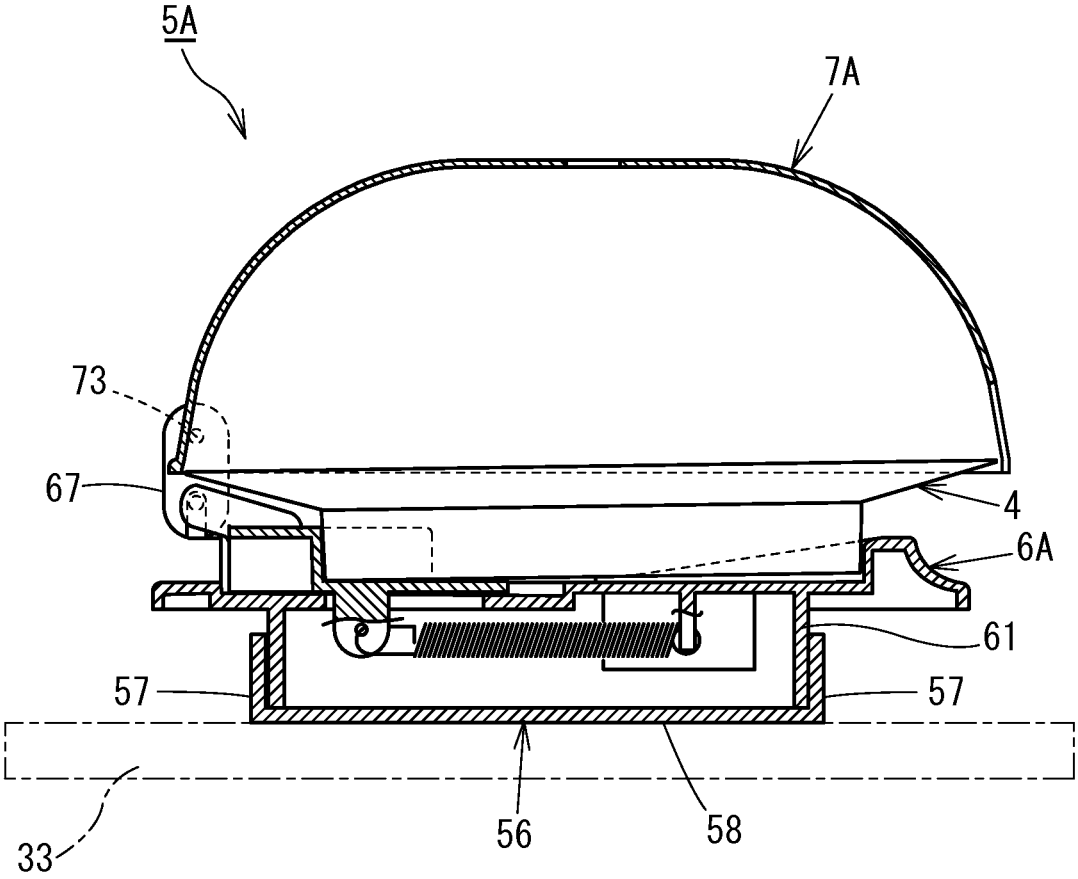
FIG. 16 is a partly-sectioned side elevation view of a relevant constitution part, illustrating the food plate carrier of another embodiment and a support member via which the mounting platform is supported in a rotatable relation.

As schematically shown in FIG. 16, a supporting member 56 may be rotatably provided at the bottom side of the mounting platform 6A so that the mounting platform 6A may be supported by the supporting member 56 in such a manner as to rotate horizontally relative to the supporting member 56. This enables the food plate carrier 5A to turn around in any direction on the flat chain conveyor 33. The supporting member 56 shown in FIG. 16 comprises a cylindrical support 57 in which the cylindrical base 61 of the mounting platform 6A is rotatably fitted, and a bottom plate 58 by which the cylindrical support 57 is closed at the bottom end.

Figure 17:
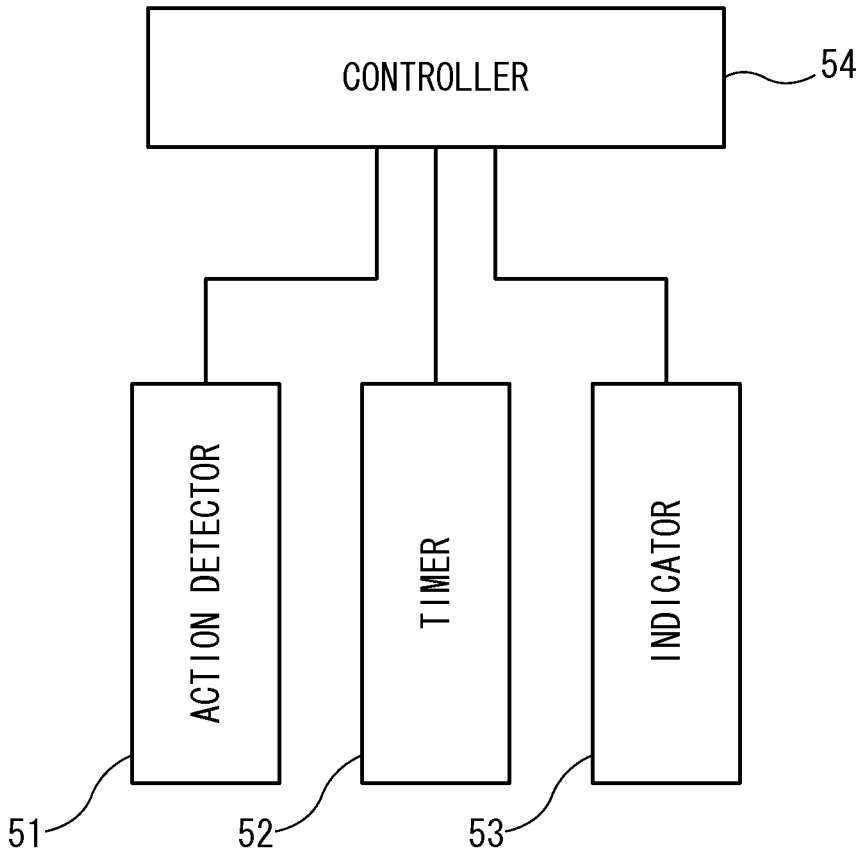
FIG. 17 is a control block diagram, illustrating an outline of the control configuration of the food plate carrier of another embodiment.

In the embodiment described above, the food plate carrier 5A comprises, as schematically shown in FIGS. 13 and 17, an action detector 51 for detecting an opening and closing action of the cap member 7A, so that it is put into the on action when the cap member 7A is closed, a timer 52 which is electrically actuated by the on action of the action detector 51 (which is an example of time detecting means), an indicator 53 of a LED lump and the like, a controller 54 for controlling those devices 52, 53, and a battery (not shown) for providing the respective devices 51, 52, 53, 54 with electricity. With the action detector 51 put into the on action by the closing of the cap member 7A, the timer 52 starts measuring the time. When the time measured by the timer 52 comes to a predetermined time preset in the controller 54, the controller 54 lights up the indicator 53. This can provide the result that the food F on the mounting platform 6A can be determined as it is on whether it already passed away the predetermined time and thus the freshness management of the food F can be made in a preferred manner. In place of the control system comprising the controller 54, another control system may be used which comprises a sand clock (not shown) which is set in the cap member 7A so as to be put into the on action by the opening and closing action of the cap member 7A so that the time taken after the closing of the cap member 7A can be measured by the sand clock. The cylindrical base 61 has, in an interior thereof, two cylindrical housings 617, 617 for balance weights 619 to prevent the food plate carrier 5A from being weighed up by the inertia force when the cap member 7A is opened. Bottom openings of the cylindrical housings 617 are sealed by sealing lids 618.

Figure 18:
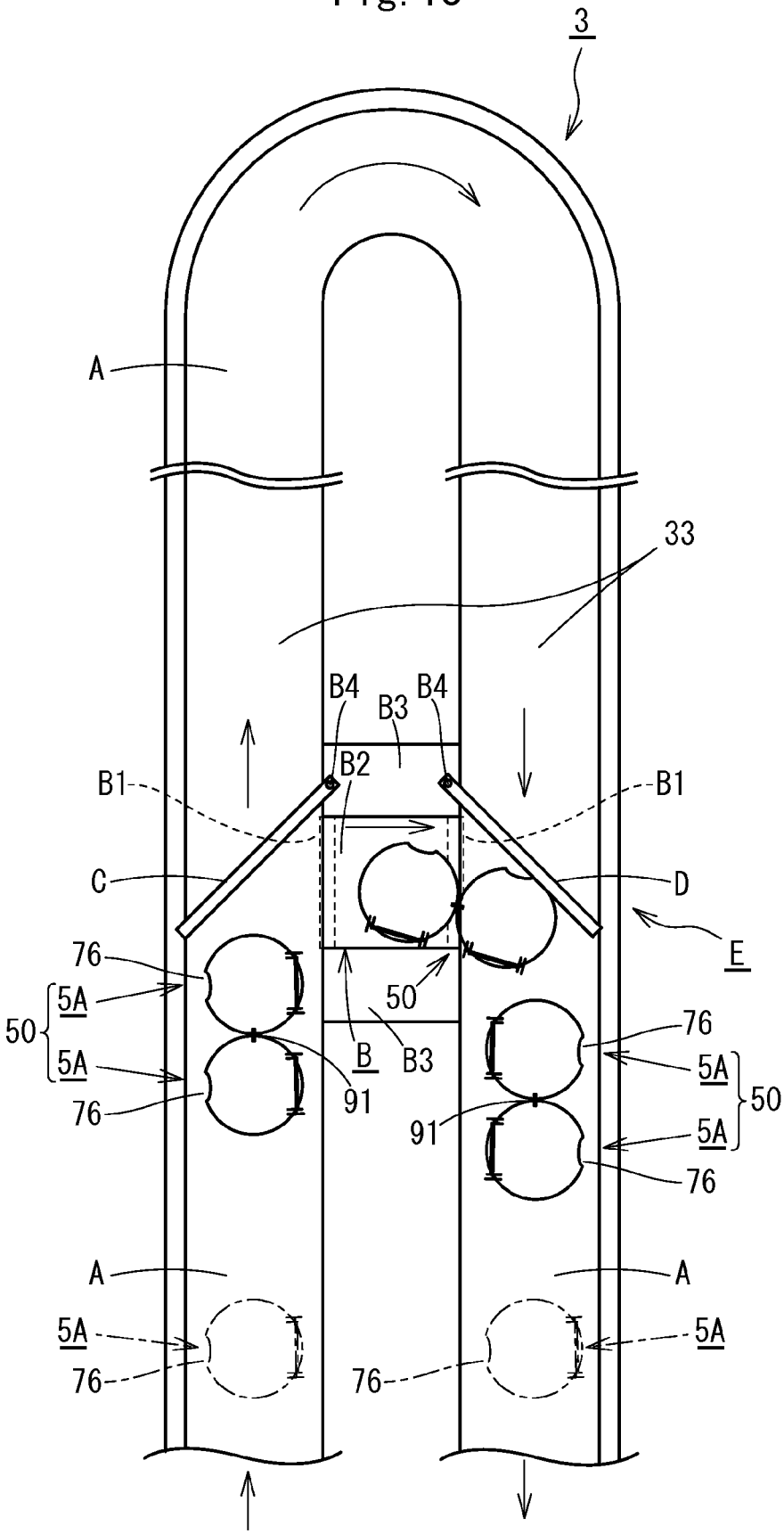
FIG. 18 is a partial plan view, illustrating the state that carrier units, each being formed by two food plate carriers of another embodiment arranged in side-by-side relation and linked to each other, are conveyed.
Figure 20:
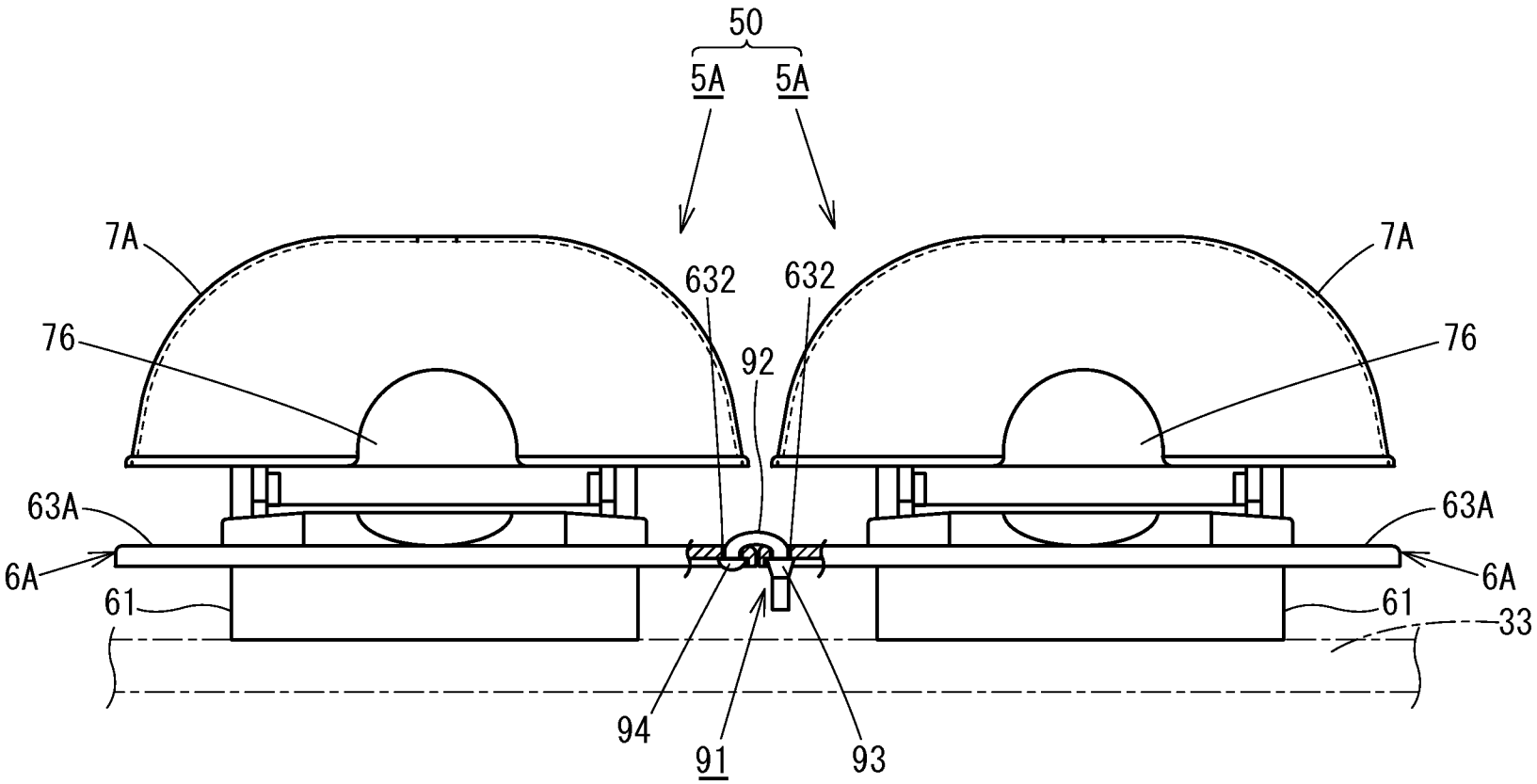
FIG. 20 is a partially sectioned front view, illustrating the carrier unit.

On the other hand, as schematically shown in FIG. 18, the food plate carrier 5A, which is used with the food conveying system 3 having a shortened conveyor line B at an intermediate portion of the conveyor line A, is structured so that after the food plate carrier 5A passes away the shortened conveyor line B of a circulatory shunt mechanism E, the take-out side of the mounting platform 63A (the side on which the cutout 76 is formed) can be naturally oriented to face the customers (table side) so that the dish 4 can be easily taken out from the mounting platform 63A. Specifically, as shown in FIG. 20, two food plate carriers 5A, 5A are arranged in side-by-side relation and their adjoining mounting platforms 6A, 6A are linked in close proximity relation, thereby forming a carrier unit 50. In this embodiment, with the front side of the mounting platforms 6A facing in the same direction, in other words, with the dish-insert side or dish-takeout side of the plate resting portions 62A facing in the same direction, the adjoining mounting platforms 6A, 6A are linked in close proximity relation via linkage means.

Figure 19:
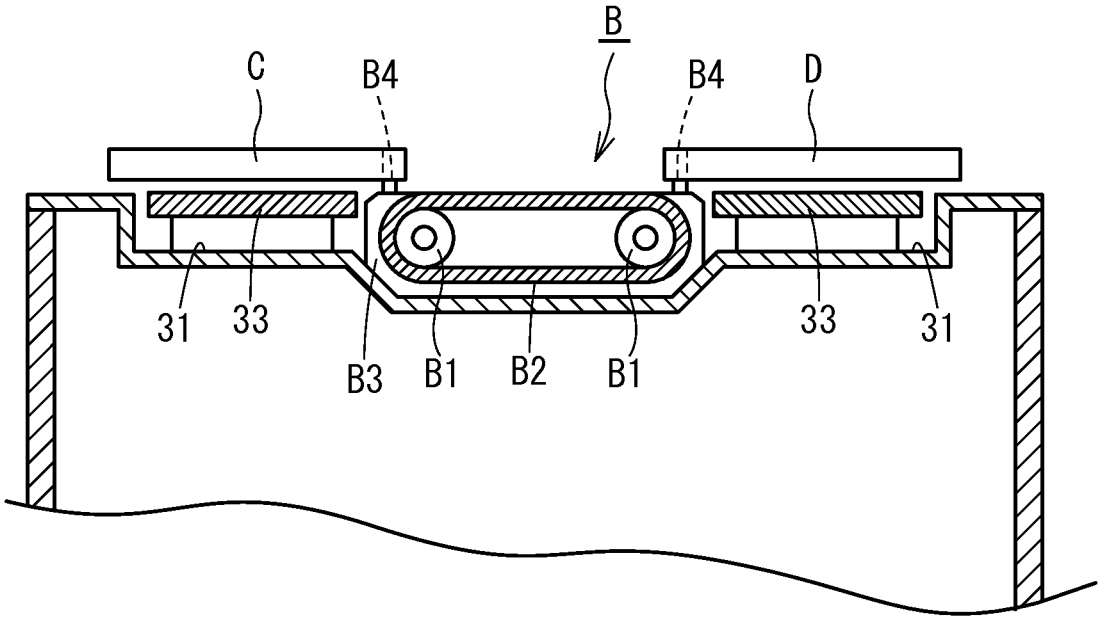
FIG. 19 is a vertical cross-sectional view, illustrating a relevant part of a circulatory shunt mechanism of the conveyor system via which the carrier unit is conveyed.

The circulatory shunt mechanism E includes the shortened conveyor line B for shunting a part of the main conveyor line A (on the front end side) at an intermediate location of the main conveyor line A of the food conveying system 3 comprising the flat chain conveyor 33. Also, the circulatory shunt mechanism E is provided, at an inlet side of the shortened conveyer line B, with a first guide member C for transferring the food plate carrier 5A conveyed by the main conveyor line A to the shortened conveyor line B. It is also provided, at an outlet side of the shortened conveyer line B, with a second guide member D for transferring the food plate carrier 5A conveyed by the shortened conveyor line B to the main conveyor line A. This can provide the result that when the restaurant is not crowded, the shortened conveyor line B is driven and a part of the main conveyor line A is shunted using the both guide members C, D to transport the food plate carrier 5A in a shortcut manner. The shortened conveyor line B comprises, as schematically shown in FIG. 19, a mounting base B3 located between two recesses 31, 31 arranged in parallel, a pair of rotating rollers B1, B1 rotatably disposed on the mounting base B3, a conveyor belt B2 endlessly looped between the rotating rollers B1, B1, a motor (not shown) for rotating one of the rotating rollers B1, and a controller (not shown) for controlling the drive of the motor. The first guide member C is rotatably mounted at one lengthwise end portion thereof on an upper surface of the mounting base B3 on the inlet side via a rod B4 so that it can pivot or swing horizontally. The second guide member D is rotatably mounted at one lengthwise end portion thereof on the upper surface of the mounting base B3 on the outlet side via a rod B4 so that it can pivot or swing horizontally. Each guide member C, D is formed by a thin plate.

Figure 21:
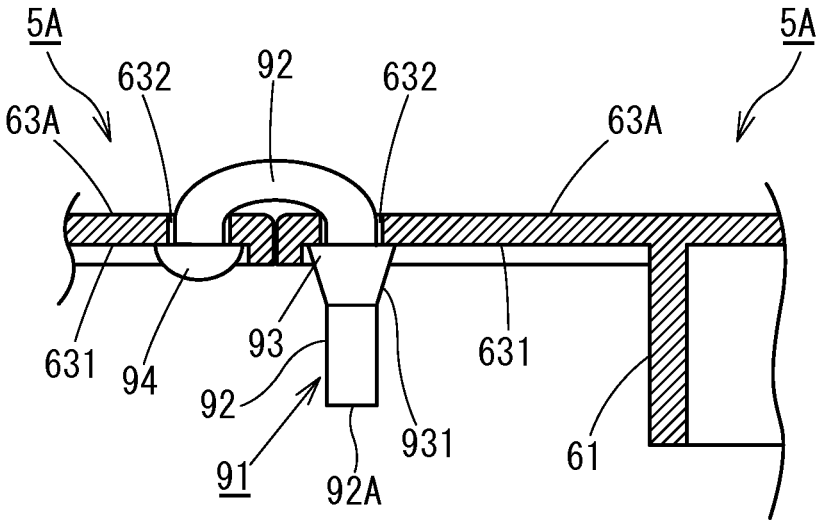
FIG. 21 is a front view, illustrating a string-like member which is linkage means for linking the food plate carriers of the carrier unit.

Linkage means shown in detail in FIG. 21 is formed by a stretchable string-like member 91. The string-like member 91 is formed of silicon rubber, for example. The string-like member 91 comprises a string main body 92 formed in a circular cross-section shape, a first retaining projection 93 of a circular truncated cone shape which is integrally formed with the string main body 92 at a lengthwise intermediate portion thereof, and a second retaining projection 94 of a semispherical shape which is integrally formed with the string main body 92 at one lengthwise end thereof. The outer surface of the first retaining projection 93 is in the form of a tapered surface 931 for guiding the first retaining projection 92 in passing through the through hole 632 formed in the mounting plate 63A. When two food plate carriers 5A, 5A are linked by the string-like member 91, one lengthwise end portion 92A of the string-like member 92 is inserted in the through hole 632 and then is pulled forcibly, with the inserted end portion 92A held with fingers. This causes the first retaining projection 93 to pass through the through hole 632, while the tapered surface 931 is subjected to elastic deformation (compressive deformation). Then, the second retaining projection 94 is retained by the lower surface 631 of one mounting plate 63A, while on the other hand, the first retaining projection 93 is retained by the lower surface 631 of the other mounting plate 63A.

When one of the pair of food plate carriers 5A, 5A linked, e.g. the food plate carrier 5A located at the rear side, gets stuck with an obstacle located near the conveyor line A, the string-like member 91 is stretched temporarily to thereby produce a tension to draw the food plate carrier 5A located at the rear side close to the one located at the front side, thereby automatically releasing the food plate carriers 5A from jamming. In addition, since the pair of food plate carriers 5A, 5A are linked in close proximity relation by the string-like member 91, when the food plate carriers thus paired are used in the shortcut operation by the shunt mechanism E, the plate takeout opening side (the cutout 76 side) of the plate resting portion 62 can always be oriented to face the customers (table side). In other words, the pair of food plate carriers 5A, 5A, which are placed front and back with respect to the traveling direction on both the main conveyer line A and the shortened conveyor line B, are pulled each other in the front and back direction, whereby the pair of food plate carriers 5A, 5A are always kept in the position where the plate takeout opening side of the plate resting portion 63A is oriented to the direction orthogonal to the conveying direction. Thus, the plate takeout opening side of the plate resting portion 63A is never oriented forwards or backwards of the travelling direction. Accordingly, even when the carrier unit 50 is shunted from the main conveyor line A to the shortened conveyor line B formed by the circulatory shunt mechanism E and thereafter is returned again to the main conveyor line A, the plate takeout opening side (the cutout 76 side) of the mounting platform 6A is always oriented to face the customer side (the table side). For reference's sake, when a single food plate carrier 5A is shunted from the main conveyor line A to the shortened conveyor line B and thereafter is returned again to the main conveyor line A, the single food plate carrier 5A is never pulled closer not only when it is moved from the main conveyor line A to the shortened conveyor line B but when it is moved from the shortened line B to the main conveyor line A. Accordingly, the single food plate carrier 5A is then kept substantially unchanged in orientation, as the food plate carrier 5A depicted by a dashed line in FIG. 18. As a result of this, the single food plate carrier 5A, when returned to the main conveyor line A from the shortened conveyor line B, is oriented in the direction in which the plate takeout opening side is positioned opposite to the customer side.

Figure 22:
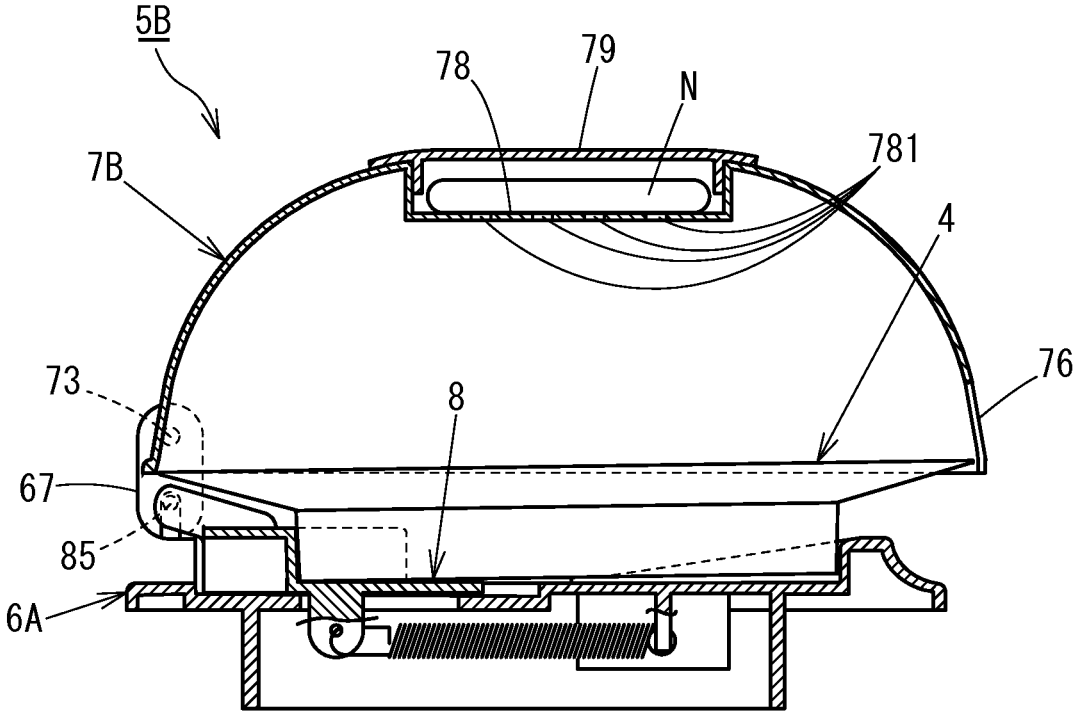
FIG. 22 is a partly-sectioned side elevation view of a relevant constitution part, illustrating the state that a cap member of the food plate carrier of still another embodiment of the invention is closed.

The illustrated food plate carrier may be formed so that the cap member is provided with an accommodation space 78 for accommodating an accommodated object N such as cold insulator or hot insulator and also a top lid 79 is detachably attached at an upper opening of the accommodation space 78, as the cap member 7B of the food plate carrier 5B shown in FIG. 22. In this arrangement, it is preferable that a through hole 781 is formed in a bottom wall of the accommodation space 78 so that a cold air of the cold insulator or a warm air of the hot insulator can flow into an interior of the cap member 7B from the accommodation space 78 through the through hole 781. The arrangement shown in FIG. 22 can prevent deterioration of the food F such as sushi accommodated more effectively. The accommodation space may alternatively be provided on the mounting platform 6A side.

Figure 23:
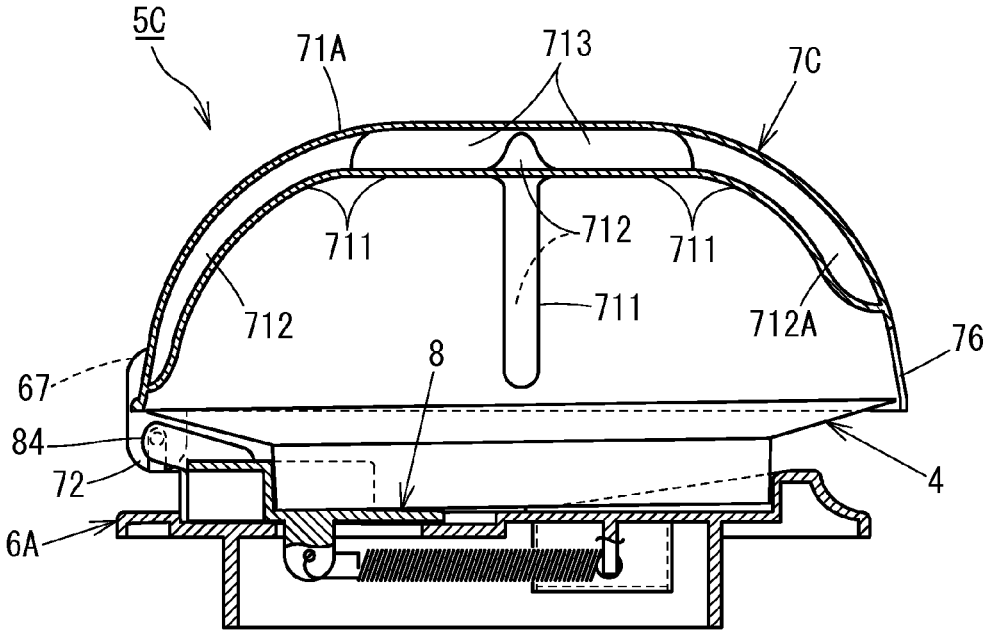
FIG. 23 is a partly-sectioned side elevation view of a relevant constitution part, illustrating the state that a cap member of the food plate carrier of a further embodiment of the invention is closed.
Figure 24:
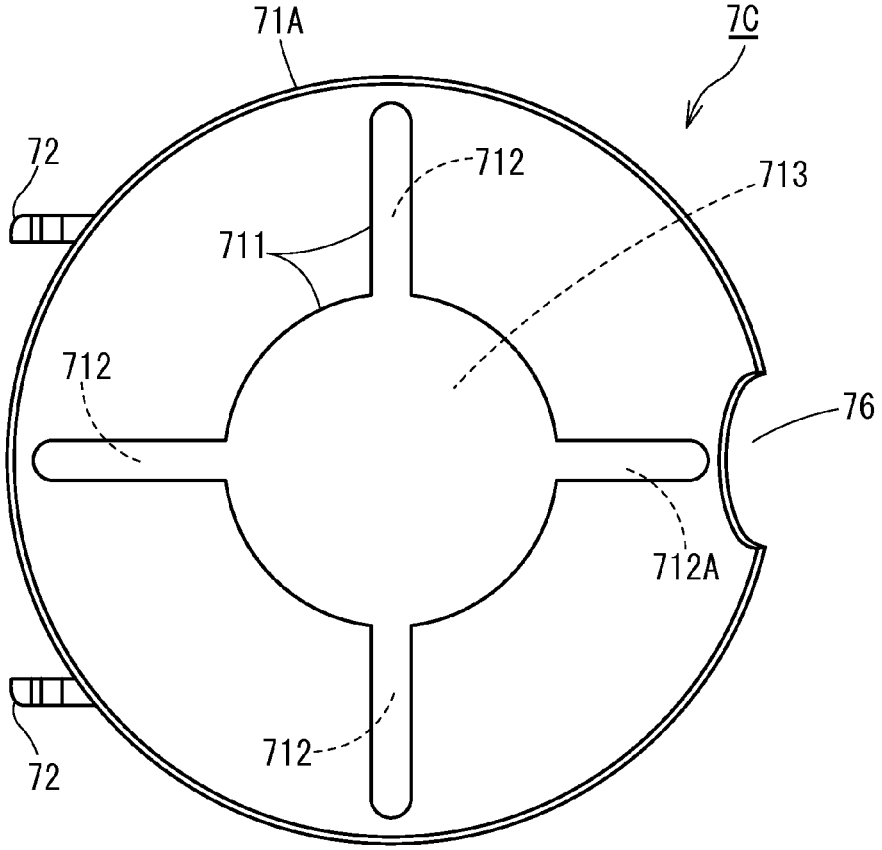
FIG. 24 is a bottom view of the cap member of the food plate carrier of the further embodiment of the invention.

The methods of cooling the food such as sushi placed in the cap body 71A include for example using a filling chamber 713 and connecting channels 712, 712 formed by confining walls 711 arranged at the inside of the cap body 71A, as is the case in the cap member 7C of the food plate carrier 5C shown in FIGS. 23 and 24. The filling chamber 713 is formed in a generally circular shape, as viewed from top of the drawing. Four connecting channels 712, 712, 712, 712A are each formed to connect with a peripheral edge of the filling chamber 713 at one end thereof and extend downwardly towards a lower peripheral edge of the cap body 71A at the other end thereof. This food plate carrier 5C enables the interior of the cap body 71A to be cooled by cold air of water as is filled in the filling chamber 713 and preliminarily frozen. When the water filled in the filling chamber 713 is frozen by a freezer, the cap body 71A should be put upside down in the freezer so that the filling chamber 713 is located in a lowermost position to freeze the water. The frozen water or ice in the filling chamber 713 is melted in the process of using the food plate carrier 5C and the water melted is gradually accumulated in the connecting channels 712, 712, 712, 712A. Since the volume of water accumulated in the connecting channels 712, 712, 712, 712A can be visibly confirmed from outside through the transparent cap body 71A, the used hours of the food plate carrier 5C can roughly be grasped. As a result, the food on the mounting platform 6A can be determined on whether it already passed away a predetermined time.

Figure 25:
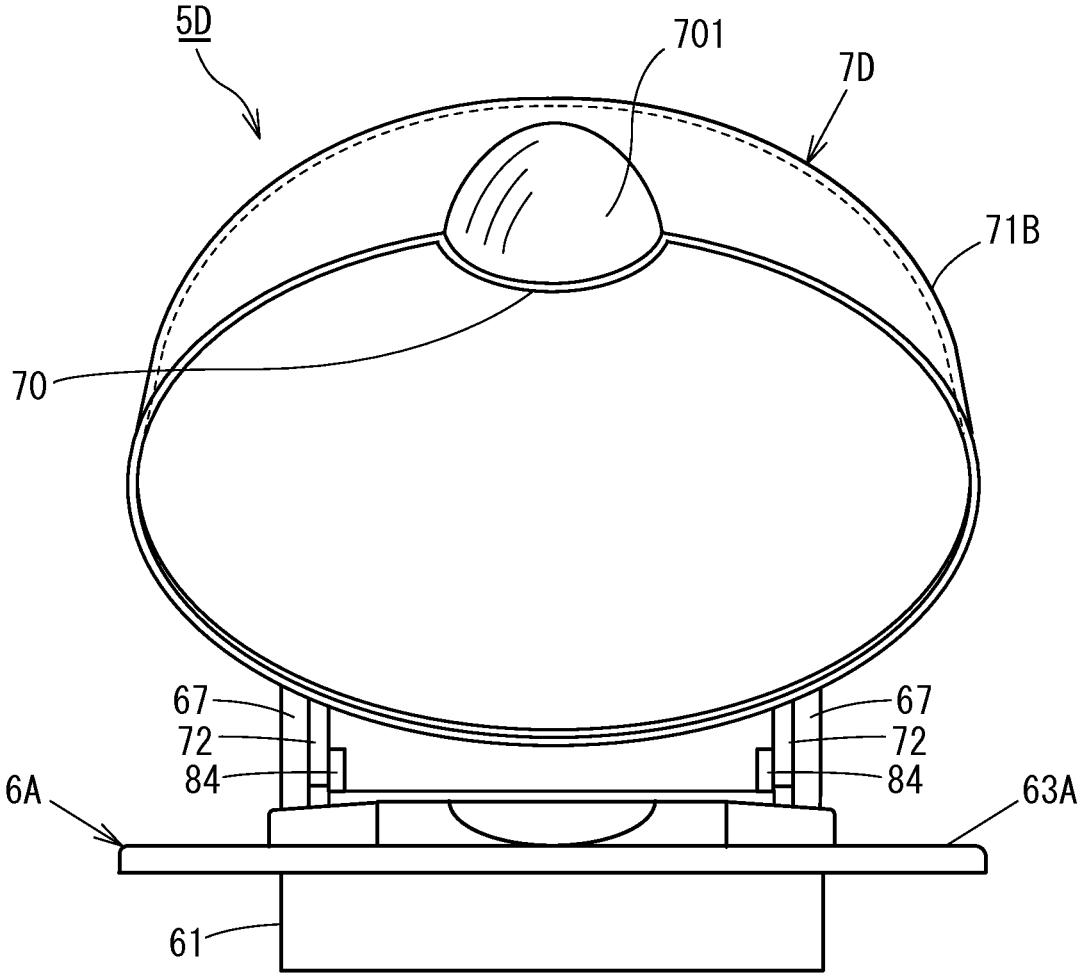
FIG. 25 is a front view, illustrating the state that a cap member of the food plate carrier of a still further embodiment of the invention is opened.

Like the cap body 7D of the food plate carrier 5D shown in FIG. 25, the cap body 71B may be formed so that a confining wall 70 for defining a recess 701 recessed inwards of the cap body 71B is formed in the peripheral edge of the cap body 71B so that the rim of the flat plate part 41 of the dish may be held with fingers within the recess 701. For reference's sake, when the cap body is formed to have the cutout 76, as the cap body 7A of the food plate carrier 5A shown in FIG. 13 and others, the interior of the cap body 7A communicates with outside through the cutout 76. In contrast to this, when the cap body is formed to have the confining wall 70, as is the case in the food plate carrier 5C, the interior of the cap body 7D can be partitioned from outside more effectively than when the cap body is formed to have the cutout 76, so that the interior of the cap body 7D may be kept from outside air more effectively. In the embodiments described above, it is more preferable that the cap body and the mounting platform should be formed of synthetic resin in which an antibacterial agent is mixed or should be coated with an antibacterial coating material.

Although in the embodiments described above, the dish 4 is illustrated as an example of the plate, the plate is not limited to it. The plates which may be used in the invention include for example bowls and cups, in addition to the dish. Also, although in the embodiments described above, sushi is illustrated as an example of the food put in the plate, the food is not limited to that. The foods which may preferably be used in the invention include for example noodles, miso-soup, ices (ice creams), and shortcakes.

Although in the embodiments described above, the cap body is attached to the mounting platform in a swingable manner, the invention is not limited to this. The invention may be modified so that the cap body may be moved linearly in a vertical direction (lifted up and down) with respect to the mounting platform so that the cap body can be opened and closed with respect to the plate resting portion by the vertical linear movement (lifting and lowering).

Although in the embodiments described above the open and close mechanism comprises the actuator arranged in such a manner as to slide in the back and forth direction along the top surface of the plate resting portion, and the coiled spring for biasing the actuator towards front with respect to the plate resting portion, the invention is not limited to this arrangement. The invention may be modified for example in such a manner that the actuator can be pivoted vertically or moved linearly with respect to the plate resting portion over the plate resting portion and the actuator can be biased upwards by the coiled spring. In other words, the invention may be arranged so that when the dish is placed on the actuator, the actuator can be swung downwards or moved down linearly by the dish's own weight against a reaction force of the coiled spring, while on the other hand, when the dish is removed from the plate resting portion, the actuator can be swung upwards or moved up linearly by the spring force of the coiled spring to open the cap body.

It is preferable to adopt the arrangement to enable the cap member to be easily detached from the mounting platform. The adoption of such an arrangement can produce the result that when the food plate carrier is washed, the cap member and the mounting platform can be separated from each other so that they can be cleaned up in a polite manner, thus providing a higher sanitary effect.

The invention claimed is:

1. A food plate carrier which is to be carried on a conveyor line of a conveying system so as to transport food to tables and seats in a restaurant, the food plate carrier comprising:

a mounting platform having a plate resting portion for putting thereon a plate on which food is put;

a cap member which is attached to the mounting platform in such a manner as to open and close with respect to the plate resting portion, to cover the plate resting portion of the mounting platform; and an open and close mechanism for allowing the cap member to close when the plate is rested on the plate resting portion and open when the plate is removed therefrom, wherein the open and close mechanism comprises an actuator which when the plate is rested onto the plate resting portion, is brought into abutment with the plate and thereby is put into action to move relative to the plate resting portion, connecting means to connect the actuator with the cap member so that the movement of the actuator is transmitted to the cap member to actuate the cap member to close, and biasing means for biasing the cap member toward its opened position.

2. The invention food plate carrier according to claim 1, wherein an identification member which is readable by a reader arranged in the food conveying system is arranged on the mounting platform in such a manner that it can switch between a readable position at which it can be read by the reader and an unreadable position in association with the opening and closing action of the cap member, the identification member being arranged so that when the plate is rested on the plate resting portion, it can be shifted to the readable position, while on the other hand, when the plate is taken out from the plate resting portion, it can be shifted to the unreadable position.

3. The food plate carrier according to claim 1, wherein adjoining mounting platforms of at least two food plate carriers arranged in side-by-side relation are linked in close proximity relation via linkage means.

4. The food plate carrier according to claim 3, wherein the linkage means is formed by a stretchable string-like member.

5. The food plate carrier according to claim 1, further comprising time detecting means for detecting the time during which the cap member closes.

6. The food plate carrier according to claim 1, further comprising an accommodation space for accommodating a cold insulator or hot insulator to keep cool or warm the space above the plate resting portion covered by the cap member.

7. A food plate carrier which is to be carried on a conveyor line of a conveying system so as to transport food to tables and seats in a restaurant, the food plate carrier comprising:

a mounting platform having a plate resting portion for putting thereon a plate on which food is put;

a cap member which is attached to the mounting platform in such a manner as to open and close with respect to the plate resting portion, to cover the plate resting portion of the mounting platform; and an open and close mechanism for allowing the cap member to close when the plate is rested on the plate resting portion and open when the plate is removed therefrom, wherein an identification member which is readable by a reader arranged in the food conveying system is arranged on the mounting platform in such a manner that it can switch between a readable position at which it can be read by the reader and an unreadable position in association with the opening and closing action of the cap member, the identification member being arranged so that when the plate is rested on the plate resting portion, it can be shifted to the readable position, while on the other hand, when the plate is taken out from the plate resting portion, it can be shifted to the unreadable position.

8. The food plate carrier according to claim 7, wherein adjoining mounting platforms of at least two food plate carriers arranged in side-by-side relation are linked in close proximity relation via linkage means.

9. The food plate carrier according to claim 8, wherein the linkage means is formed by a stretchable string-like member.

10. The food plate carrier according to claim 7, further comprising time detecting means for detecting the time during which the cap member closes.

11. The food plate carrier according to claim 7, further comprising an accommodation space for accommodating a cold insulator or hot insulator to keep cool or warm the space above the plate resting portion covered by the cap member.

12. A food plate carrier which is to be carried on a conveyor line of a conveying system so as to transport food to tables and seats in a restaurant, the food plate carrier comprising:

a mounting platform having a plate resting portion for putting thereon a plate on which food is put;

a cap member which is attached to the mounting platform in such a manner as to open and close with respect to the plate resting portion, to cover the plate resting portion of the mounting platform; and an open and close mechanism for allowing the cap member to close when the plate is rested on the plate resting portion and open when the plate is removed therefrom, wherein adjoining mounting platforms of at least two food plate carriers arranged in side-by-side relation are linked in close proximity relation via linkage means, and wherein the linkage means is formed by a stretchable string-like member.

13. The food plate carrier according to claim 12, further comprising time detecting means for detecting the time during which the cap member closes.

14. The food plate carrier according to claim 12, further comprising an accommodation space for accommodating a cold insulator or hot insulator to keep cool or warm the space above the plate resting portion covered by the cap member.

* * * * *